US005980203A

United States Patent [19]

Zatorski et al.

[11] Patent Number: 5,980,203

[45] Date of Patent: Nov. 9, 1999

[54] SPARK-PREVENTION COATING FOR OXYGEN COMPRESSOR SHROUD

[75] Inventors: Raymond A. Zatorski, East Hampton, Conn.; Janet R. Linsey, Jupiter, Fla.; Timothy J. Tabor, Andover, Conn.; Robert A. Palladino, Enfield, Conn.

[73] Assignee: Atlas Compco Comptec, Voorheesville, N.Y.

[21] Appl. No.: 08/862,976

[22] Filed: May 23, 1997

Related U.S. Application Data

[60] Provisional application No. 60/019,178, Jun. 5, 1996.

[51] Int. Cl.[6] ..... F01D 9/00

[52] U.S. Cl. ..... 415/173.004; 415/174.4; 415/174.5

[58] Field of Search ..... 415/173.4, 174.4, 415/174.5; 427/455, 456, 422, 405; 29/888.02, 888.025, 527.2

[56] References Cited

U.S. PATENT DOCUMENTS

| | | | |
|---|---|---|---|
| 4,037,998 | 7/1977 | Goloff . | |
| 4,056,339 | 11/1977 | Doi et al. . | |
| 4,207,024 | 6/1980 | Bill et al. . | |
| 4,405,284 | 9/1983 | Albrecht et al. | 415/174 |
| 4,526,839 | 7/1985 | Herman et al. | 428/550 |
| 4,867,639 | 9/1989 | Strangman . | |
| 5,064,727 | 11/1991 | Naik et al. | 428/593 |
| 5,268,045 | 12/1993 | Clare | 148/518 |

*Primary Examiner*—Christopher Verdier
*Assistant Examiner*—Ninh Nguyen
*Attorney, Agent, or Firm*—Wall Marjama Bilinski & Burr

[57] ABSTRACT

A shroud which has an inner surface configured to surround an impeller, with the surface comprising a metallic substrate, and a metallic bond coat overlaying the substrate. A porous spark resistant abradable silver or silver alloy layer overlays the bond coat. The method of forming the porous silver layer is also disclosed.

4 Claims, 2 Drawing Sheets

SPARK-PREVENTION COATING FOR OXYGEN COMPRESSOR SHROUD

CROSS REFERENCE TO RELATED APPLICATION

Reference is made to and priority claimed from U.S. Provisional Application Ser. No. 60/019,178 filed Jun. 5, 1996, entitled "Spark-Prevention Coating for Oxygen Compressor Shroud".

FIELD OF THE INVENTION

This invention relates generally to a non-sparking abradable coating for compressors, and more specifically, the invention relates to a flame sprayed porous silver coating which is applied to the inner surface of a compressor shroud and which can accept the incursion of an impeller without generating sparks.

BACKGROUND OF THE INVENTION

Oxygen compressors run the risk of fire in the event that there is a rub or contact between a rotating part and a stationary part. In the presence of pure, high pressure oxygen, the heat generated by a rub can start combustion of most ordinary metals, including iron, steel, stainless steel, aluminum, titanium and bronze. One approach considered by the prior art is to line the shroud of an oxygen compressor with leaded bronze, and design for a higher than normal clearance between the stainless steel impeller and the bronze. However, tests indicate that in the event of a rub, stainless steel rubbing on porous silver provides a higher safety margin than stainless steel rubbing on bronze.

Silver is known to be one of the best materials for the stationary parts of oxygen compressors, but the prior art has not taught a reliable way to provide a silver surface on the inner surface of a shroud. Porosity can be achieved by the addition of plastic powder (fugitive) to the metal powder prior to spraying. In this the fugitive process, however, there is no way to insure that all the plastic is removed without changing the favorable mechanical properties of the metal.

The following prior art patents relate to porous and/or abradable materials which are used with motors and compressors:

U.S. Pat. No. 4,037,998 to Goloff is directed to an improved rotary engine which utilizes a thin wear resistant metal layer located in sealing engagement with the rotor as the motor moves within the chamber. A backing for the thin layer is formed of a metal having a high thermal conductivity, and is provided with a plurality of relatively closely spaced cooling passages to provide for an improved cooling structure for the engine to thereby extend its life. The metals taught include copper, brass, aluminum and magnesium.

U.S. Pat. No. 4,056,339 to Doi et al. is directed to a rotary piston type internal combustion engine in which the rotor housing is plated with a pin-point porous chromium plating having a porosity in the range of 10–60% with a certain specified hardness. Tile porosity appears to be used for its oil retaining properties.

U.S. Pat. No. 4,207,024 to Bill et al. is directed to a composite seal for turbo machinery in which the shroud contains a compliant backing and where the compliant material of the backing is covered with a thin ductile layer. The thin layer may be a metal or metal alloy layer formed from a dense plasma sprayed soft metal such as aluminum or bonded metal sheath or foil.

U.S. Pat. No. 4,867,639 to Strangman is directed to abradable shroud coatings that are applied to a turbine or compressor shroud structure to facilitate reduction in blade tip-to-shroud clearance for improved engine performance or airfoil durability. The coating may include soft burnishable ceramic material such as $CaF_2$ or $BaF_2$ in a ceramic or a metallic matrix or honeycomb structure.

An objective of the present invention is to provide for an abradable, non-sparking metallic layer that is easily abraded in the event of contact with another metal, and which overcomes the problems and limitations of the prior art described above.

SUMMARY OF THE INVENTION

The present invention is directed to a thermally-sprayed silver or silver alloy layer with enhanced porosity and bond integrity which is formed on the inner surface of a shroud. The enhanced porosity is achieved by spraying with customized gun parameters rather than the use of a fugitive. This eliminates any possibility of fugitive residue in the coating which could contribute to a fire or an explosion. Bond integrity is achieved by machining threads or otherwise scoring the inner surface of the shroud, and applying dense or nonporous underlayers of nickel-aluminum and then a silver or silver alloy layer by conventional thermal spraying. The porous layer is then formed over these two layers by thermal or flame spraying. The enhanced porosity enables the silver to densify during an incursion and, combined with the enhanced bond integrity, provides the coating the right amount of structural integrity to withstand an incursion with minimal, if any, disbonding. In an alternative embodiment, the dense or nonporous silver or silver alloy layer may be eliminated.

The top layer or coating may be pure silver, or a suitable silver alloy with porosity throughout leading to intentionally poor strength. Consequently, the coating is easily abraded in the case of a rub. Very little energy is developed during the rub, so very little heat is generated. Furthermore, with silver being a very good conductor, the temperature rise is quite small. Thus, the chance of a fire is greatly reduced since the parts do not reach ignition temperature. The preferred application for this coating is for the inner surface of an oxygen compressor shroud which is configured to surround the compressor impeller.

BRIEF DESCRIPTION OF THE DRAWING

For a fuller understanding of the nature and objects of the invention, reference should be made to the following detailed description of a preferred mode of practicing the invention, read in connection with the accompanying drawings,in which.

DETAILED DESCRIPTION OF THE INVENTION

Figure 1:
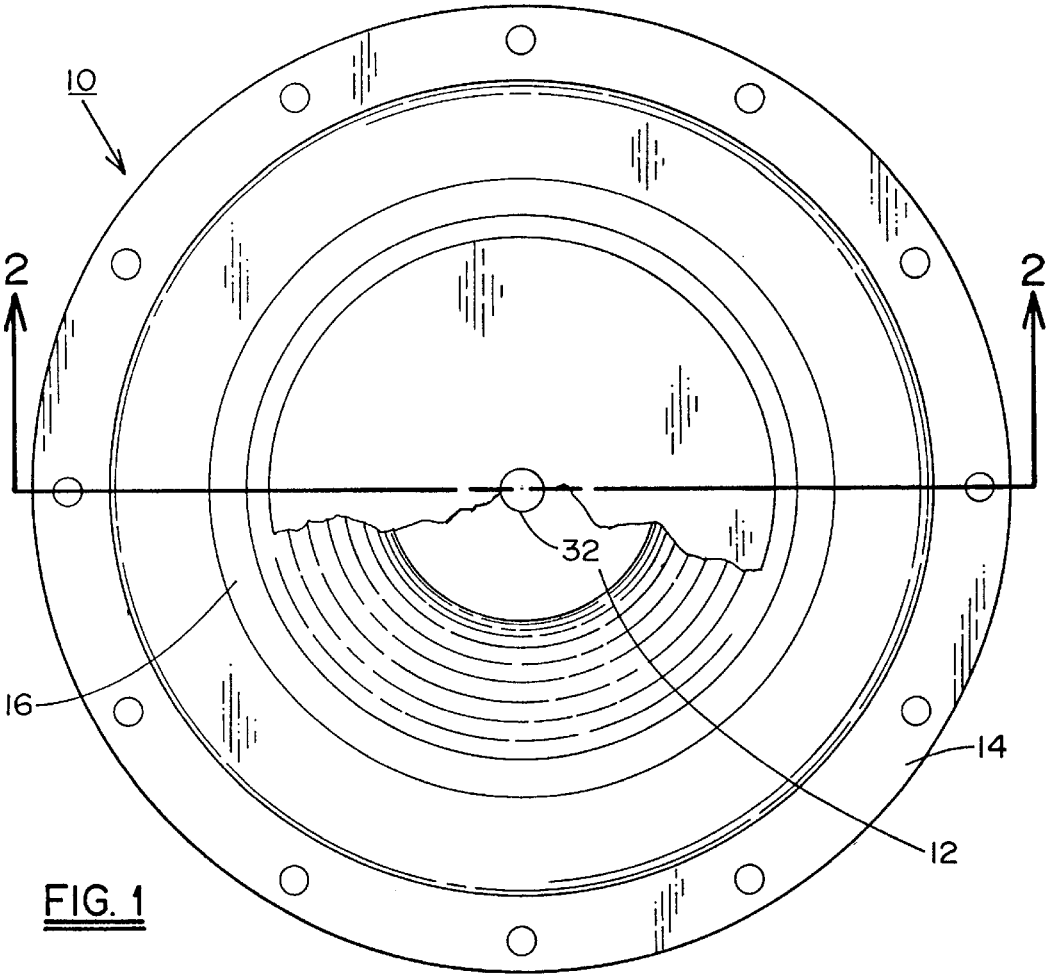
FIG. 1 is a top plan view of one embodiment of a shroud of the present invention which surrounds an impeller.
Figure 2:
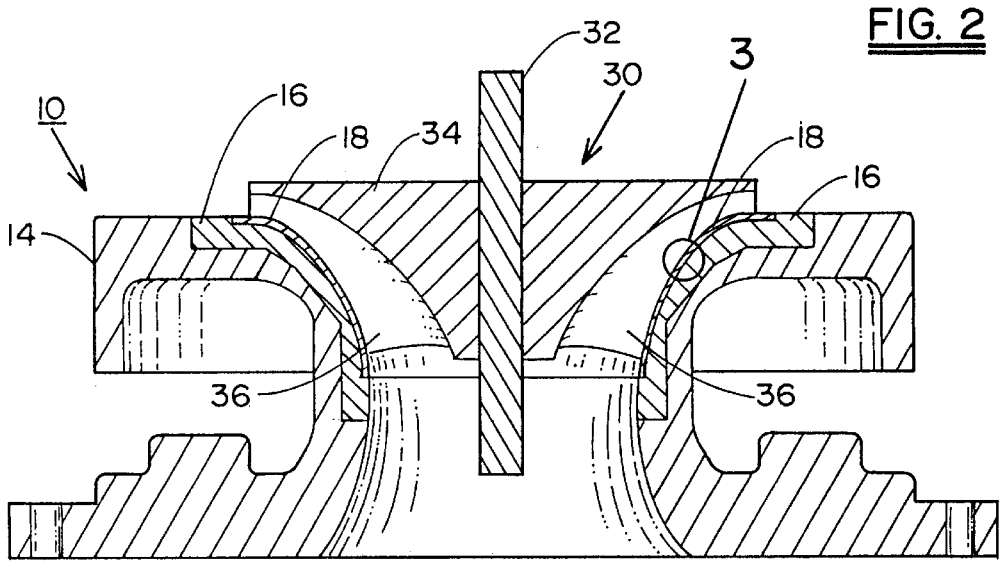
FIG. 2 is a sectional view of the shroud and impeller shown FIG. 1 taken along line 2—2.
Figure 4:
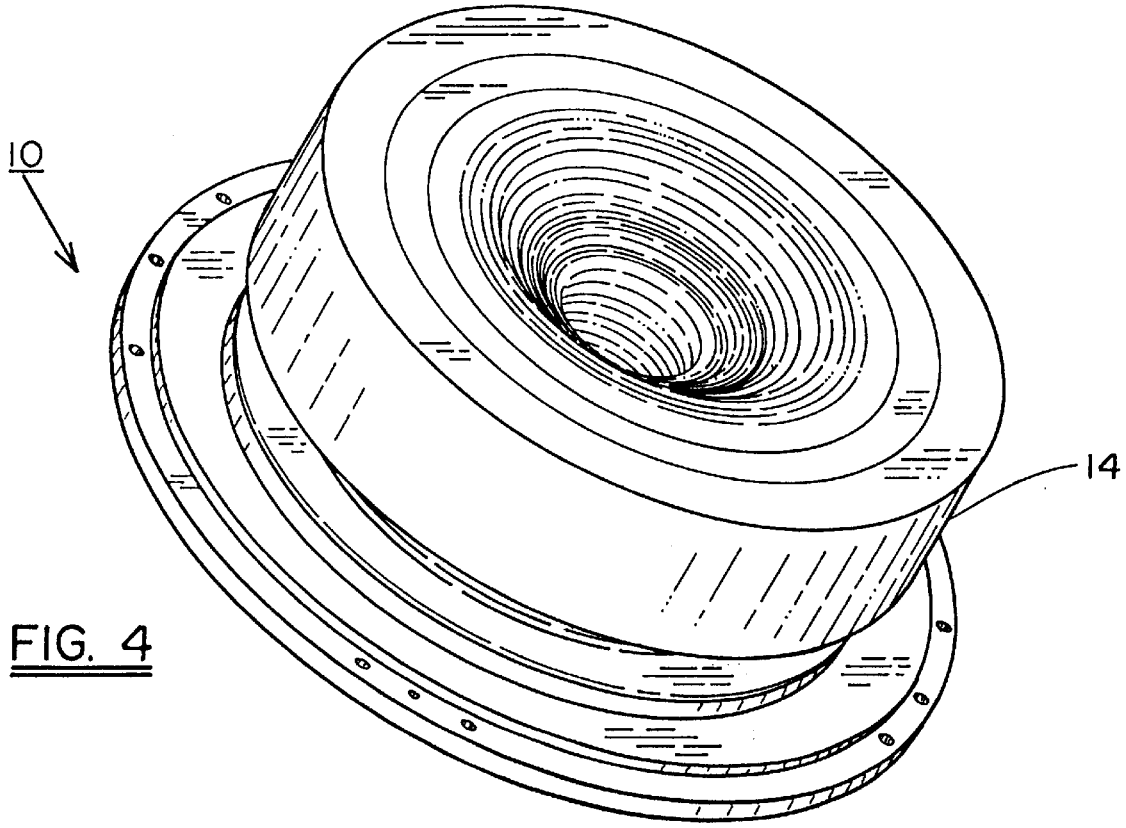
FIG. 4 is a perspective view of the shroud shown in FIGS. 1 and 2 with the impeller removed.

Referring to FIGS. 1 and 2, the compressor shroud 10 of the present invention is illustrated in a plan view in FIG. 1 and as a sectional view taken along line 2—2 shown in FIG. 2. The shroud contains an inner contoured cavity 12 and an outer frame 14. The frame 14 in one embodiment comprises nodular iron with the contoured inner cavity containing a bronze liner 16. A composite abradable metal coating 18 is formed by conventional thermal or flame spraying over the bronze liner. The outer surface of composite coating 18 comprises an abradable porous silver to be described in greater detail herein. The inner cavity further contains an impeller 30 which comprises an impeller hub 34 and impeller blades 36 supported on a rotating shaft 32. A perspective view of shroud 10 without the impeller is illustrated in FIG. 4.

Figure 3:
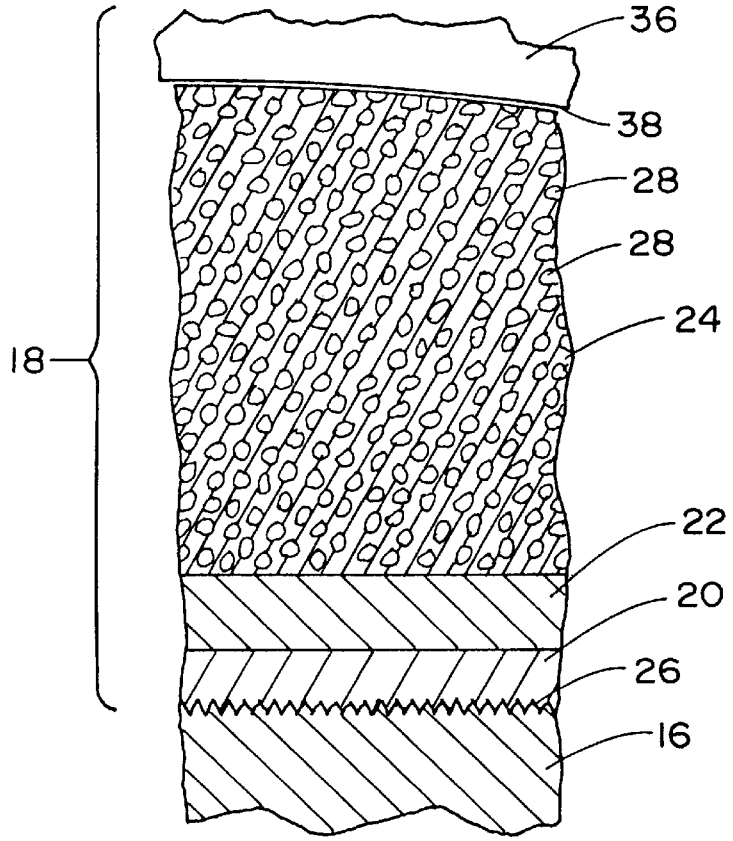
FIG. 3 is an enlarged sectional view of area 3 of FIG. 2.

FIG. 3 is an enlarged sectional view of the area 3 of FIG. 2 illustrating the three layers which make tip composite layer 18. The composite layer 18 is made up of individual layers 20, 22 and 24 and is formed on the surface of bronze insert 16 which is typically about ½ inch in thickness. The composite layer comprises a nonporous metallic bond layer 20 of a 405 nickel-aluminum alloy contained on the surface of bronze insert 16. The interface between the two layers is enhanced by machining threads 26 into the surface of bronze insert 16 in order to provide greater surface contact and adhesion of layer 20. A nonporous silver alloy layer 22 (439 silver alloy) is formed over layer 20 and a porous abradable silver alloy layer 24 (439 silver alloy) is then formed on layer 22. The alloys for layers 20, 22 and 24 are commercially available from the following sources: The 405 nickel-aluminum alloy is commercially available from Sulzer Metco (US), Inc. (hereinafter "Metco") of Westbury, N.Y. The 439 silver alloy (Item B6000) is commercially available from Stern-Leach/Vennerbeck of Lincoln, R.I. The pores or voids 28 in layer 24 constitute between about 20 to 80% by volume of the layer. The porous structure is accomplished by controlling the gun standoff distance which is a technique well known in the art. A thin gap 38 approximately 0.02 to 1.0 mm thick illustrates the clearance between the top surface of the abradable porous silver layer in the surface of impeller blade 36 as illustrated in FIG. 3.

The thermal or flame spraying method and hardware used to form the coatings of the present invention which are described below are conventional in the art.

The following hardware and specifications set forth the procedures under which the non-sparking abradable porous silver coatings of the present invention are made.

Gun Hardware

Gun: Metco 5K

Nozzle (0.125 in.): 5K7 48

Air Cap: 5K EC

Siphon Plug: 5K2 5

Gears: Standard

Gun Mode: Auto

Gun Parameters

Note: The following parameters are set using a Metco 6C console. The oxygen, acetylene and air pressures used were 35 psi, 15 psi and 65 psi, respectively.

| Console Flow Setting | Bond Coat | Dense Silver | Porous Silver |
|---|---|---|---|
| Oxygen | 43.0 | 43.0 | 43.0 |
| Acetylene | 40.0 | 40.0 | 40.0 |
| Air Supply | 65.0 | 65.0 | 75.0 |
| Gun Standoff (in): | 10.0 | 10.0 | 15.0 |

-continued

| Gun Parameters | Bond Coat | Dense Silver | Porous Silver | Wire Diameter |
|---|---|---|---|---|
| Wire Type: | 405 (Nickel Aluminum) | Silver (#439 alloy) | Silver (#439 alloy) | 0.125 |
| Wire Speed Setting: | 250 | 210 | 325 | |

Note: The above wire speeds are set using a Metco 6C console. The wire is part of the gun set up and is selectively fed at a predetermined rate to the nozzle of the gun.

Motion Control

GMF 6 axis robot 2 axis turntable

RPM: Varies as the gun moves over the contour of the part and is different for each group of parts.

Gun Speed: Varies as the gun moves over the contour of the part and is different for each group of parts.

Coating Thickness

| Bond Coat | Dense Silver | Porous Silver |
|---|---|---|
| 0.003 in.–0.004 in. | 0.006 in.–0.010 in. | 0.04 in.–0.25 in. |

Part Preparation

Grit Type: Silicon Carbide

Grit Mesh: #24 & #60 (50/50 blend)

Pressure (psi): 60

Nozzle Size: ¼ in.–⅜ in.

Nozzle Stand Off (in.): 5 in.–7 in.

In one embodiment of the present invention, a Metco 5K gun having the specifications described above is set up using a 10-inch standoff to set up the robot. The surface speed of the part being coated varied from about 50 to 100 ft/min. The gun movement shifted the area being coated by an effective distance of 2 to 30 mm per revolution. At the mid point of coating, the surface speed was 60 ft/mm while the distance between rotations was 29.5 mm. The bond coat was carried out with a single pass at a 10-inch gun standoff, 4 passes were made to form the dense silver coat at a 10-inch gun standoff, and 15 passes were made to form the porous silver coating at a 15-inch gun standoff. Overall, the thermal spraying of the silver was accomplished by using a gun speed of between 1 mm/sec to 50 mm/sec and a shroud rpm of between 5 to 150, which gave the coating a porosity of between 20 to 80% voids.

While the present invention has been particularly shown and described with reference to the preferred mode as illustrated in the drawings, it will be understood by one skilled in the art that various changes in detail may be effected therein without departing from the spirit and scope of the invention as defined by the claims.

We claim:

1. A shroud which has an inner surface configured to surround an impeller, said inner surface comprising a metallic substrate, a metallic bond coat overlaying said substrate, a dense silver or silver alloy interlayer overlaying said metallic bond coat and a porous silver or silver alloy layer overlaying said dense silver layer.

2. The shroud of claim 1 in which the porosity of the porous layer ranges from about 20 to 80% by volume.

3. The shroud of claim 1 in which the substrate is scored to enhance adhesion of the bond coat.

4. The shroud of claim 1 in which the thickness of porous layer is about 0.04 to 0.25 inches.

* * * * *